United States Patent [19]

Okutsu et al.

[11] Patent Number: 4,668,605

[45] Date of Patent: May 26, 1987

[54] METHOD FOR FORMATION OF HIGH CONTRAST NEGATIVE IMAGES

[75] Inventors: Eiichi Okutsu; Mitsunori Hirano, both of Kanagawa, Japan

[73] Assignee: Fuji Photo Film Co., Ltd., Kanagawa, Japan

[21] Appl. No.: 741,417

[22] Filed: Jun. 5, 1985

[30] Foreign Application Priority Data

Jun. 5, 1984 [JP] Japan ..... 59-114735

[51] Int. Cl.[4] ..... G03C 5/30

[52] U.S. Cl. ..... 430/267; 430/268; 430/439; 430/482; 430/489

[58] Field of Search ..... 430/267, 268, 439, 482, 430/489

[56] References Cited

U.S. PATENT DOCUMENTS

| | | | |
|---|---|---|---|
| 2,892,715 | 6/1959 | Hunsberger | 430/482 |
| 4,224,401 | 9/1980 | Takada et al. | 430/439 |
| 4,269,929 | 5/1981 | Nothnagle | 430/267 |
| 4,452,882 | 6/1984 | Akimura et al. | 430/267 |

*Primary Examiner*—Richard L. Schilling

*Attorney, Agent, or Firm*—Sughrue, Mion, Zinn, Macpeak & Seas

[57] ABSTRACT

A silver halide photographic material containing a hydrazine derivative of the general formula (I):

$$R_1\text{—NHNHCHO} \quad \text{(I)}$$

wherein $R_1$ is a substituted or unsubstituted aryl group, is developed with high contrast by the use of an aqueous alkaline developer having a pH value of 10.5 to 12.3 and comprising the following components (1) through (5):

(1) a dihydroxybenzene type developing agent;

(2) a p-aminophenol type developing agent;

(3) at least 0.3 mol/l of a sulfite preservative;

(4) 0.05 to 0.30 mol/l of an alkanolamine of the general formula (II):

$$(C_2H_5)_2N\text{—}R_2 \quad \text{(II)}$$

wherein $R_2$ is a hydroxyalkyl group having 2 to 10 carbon atoms; and (5) $10^{-4}$ to $10^{-2}$ mol/l of a mercapto compound of the general formula (III);

(III)

where $M_1$ and $M_2$ are the same or different and each is a hydrogen atom, an alkali metal atom or an ammonium group;

whereby a negative image of high contrast may be formed on said photographic material.

9 Claims, No Drawings

METHOD FOR FORMATION OF HIGH CONTRAST NEGATIVE IMAGES

FIELD OF THE INVENTION

The present invention relates to a method for high contrast development of silver halide photographic materials, and in particular, to a method for formation of a high contrast negative image which is especially suitable to a photomechanical process for printing graphic arts.

BACKGROUND OF THE INVENTION

In the field of graphic arts, an image formation system capable of giving a high contrast photographic characteristic is required to attain a good reproduction of a halftone image of continuous gradation as well as a good reproduction of a line image.

A specific developer called a lith developer has heretofore been used for said purpose. The lith developer contains only hydroquinone as a developing agent, and uses a sulfite preservative in the form of an adduct of sulfite with formaldehyde in order not to deteriorate the infectious development, therefore the concentration of free sulfide ion in said developer must be kept extremely low. Thus, the lith developer is extremely easily oxidized with air and can not last more than three days, which is a serious defect.

Methods for obtaining a photographic characteristic of high contrast by the use of a stable developer are disclosed in U.S. Pat. Nos. 4,224,401, 4,168,977, 4,166,742, 4,311,781, 4,272,606, 4,211,857 and 4,243,739, where a hydrazine derivative is used. According to said methods, a photographic characteristic of high contrast and high sensitivity may be obtained, and moreover, addition of a sulfite of high concentration to a developer is possible. Accordingly, the stability of the developer against aerial oxidation is markedly improved, as contrasted with the conventional lith developer.

In said methods using a hydrazine derivative, however, the pH value of the developer is kept higher than that of the conventional lith developer, and therefore, said pH value of the developer is apt to easily vary, resulting in a variation of the developed photographic characteristics. This is a troublesome problem.

U.S. Pat. No. 4,269,929 discloses, in order to solve said problem, the use of an alkaline developer containing a dihydroxybenzene developing agent and a 3-pyrazolidone developing agent, to which an amino compound is added so as to improve the activity of the developer; whereby said developer having a lower pH value can show the high sensitivity and high contrast image forming effect of the hydrazine derivative.

It is impossible, however, to sufficiently lower the pH value of the developer enough to stop the variation of said pH value under the condition of general preservation of the developer or conventional use of the developer in a developing machine (i.e., without severe control of a temperature, pH, amount and the like of the developer) even by said means as described in U.S. Pat. No. 4,269,929.

In addition, the amino compounds added to said developer act as a solvent of a silver halide. (Refer to *The Theory of the Photographic Process,* 3rd Ed., p. 370, written by C. E. K. Mees, and *Photographic Processing Chemistry,* p. 43, written by L. F. A. Mason.) Under the circumstances, the method for the development according to said U.S. Pat. No. 4,269,929 where a large amount of amino compounds is used has the problem of a so-called "silver stain". Said "silver stain" is a defective phenomenon, often occurring during development. Silver stain occurs, for example, as follows: In a method for development of a silver halide photographic material using an automatic developing machine where a replenishing solution is fed into the development tank, in accordance with the area of the film to be developed, the developer in the tank is used for a long period of time. As a result, the silver halide component released from the film is deposited and precipitated on the surface of the wall of the development tank or on the surface of the roller of the film conveyor. This silver deposit is then transferred to new film that is developed. This silver deposit transferring to new film is a defect, and is the silver stain in question.

A general means to eliminate said defective silver stain is to add some compounds, which are called silver stain inhibiting agents, to the developer. Various kinds of compounds have heretofore been known as said silver stain inhibiting agents and include, for example, 2-mercapto-1,3,4-thiadiazoles (British Pat. No. 940,169), 2-mercapto-1,3,4-oxadiazoles or 1-phenyl-5-mercaptotetrazoles (U.S. Pat. No. 3,173,789), DL-6,8-dithiooctanoic acid (U.S. Pat. No. 3,318,708), o-mercaptobenzoic acid (British Pat. No. 1,144,481), aliphatic mercaptocarboxylic acids (U.S. Pat. No. 3,628,955), L-thiazoline-4-carboxylic acid (*J. Photogr. Sci.,* 13, 233 (1965)), 2-mercaptobenzoxazole or 2-mercaptobenzimidazole (*Photogr. Sci. Eng.,* 13, 220 (1976), Japanese Patent Application (OPI) Nos. 24347/81 and 72411/81 (the term "OPI" as used herein refers to a "published unexamined Japanese patent application")), etc.

It has been noticed, however, that many of said silver stain inhibitory agents are, when applied to a high contrast development process using a hydrazine derivative, apt to injure or deteriorate the effect of sensitization and high contrast development attainable by said hydrazine derivative. Under the circumstances, some other compounds capable of effectively preventing the silver stain without deteriorating the effect of the hydrazine derivatives for sensitization and high contrast development must be used.

No compounds have heretofore been known, which may satisfy said requirement.

SUMMARY OF THE INVENTION

The object of the present invention is therefore to provide a method for formation of a high contrast negative image by means of a hydrazine derivative, where the variation of the developed photographic characteristic is less, depending upon the variation of the pH value of the used developer and silver stain does not occur during the development operation.

Said object of the present invention can be attained by treating or developing a silver halide photographic material containing a hydrazine derivative of the general formula (I):

$$R_1\text{—NHNH—CHO} \qquad \text{(I)}$$

where $R_1$ is a substituted or unsubstituted aryl group, with an aqueous alkaline developer having a pH value of 10.5 to 12.3 and comprising the following components (1) through (5):

(1) a dihydroxybenzene type developing agent;

(2) a p-aminophenol type developing agent;

(3) at least 0.3 mol/l of a sulfite preservative;

(4) 0.05 to 0.30 mol/l of an alkanolamine of the general formula (II):

$$(C_2H_5)_2N—R_2 \quad (II)$$

where $R_2$ is a hydroxyalkyl group having 2 to 10 carbon atoms; and (5) $10^{-4}$ to $10^{-2}$ mol/l of a mercapto compound of the general formula (III):

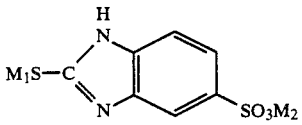

(III)

where $M_1$ and $M_2$ are the same or different and each is a hydrogen atom, an alkali metal atom or an ammonium group;

whereby a negative image of high contrast can be formed on said photographic material.

The image formation method according to the present invention, as mentioned above, uses a combination of said dihydroxybenzene type developing agent and said p-aminophenol type developing agent, as the essential developing agent, and therefore, in the method of the present invention the variation of the developed photographic characteristic is less, depending upon the variation of the pH value of the used developer, and the photographic characteristic is more stable in various treating conditions, than the development method as disclosed in U.S. Pat. No. 4,269,929 where a combination of a dihydroxybenzene type developing agent and a 3-pyrazolidone type developing agent is used as a developer. Thus, the present invention is more advantageous than that U.S. patent. In addition, the above mentioned component (5) of the present developer has the specific effect of preventing silver stain without injuring or deteriorating the high contrast effect of the hydrazine derivatives in the photographic materials developed.

DETAILED DESCRIPTION OF THE INVENTION

The present invention will now be explained in more detail.

Dihydroxybenzene type developing agents to be used in the present invention include hydroquinone, chlorohydroquinone, bromohydroquinone, isopropylhydroquinone, methylhydroquinone, 2,3-dichlorohydroquinone, 2,3-dibromohydroquinone, 2,5-dimethylhydroquinone, etc., and among them, hydroquinone is especially preferred.

p-Aminophenol type developing agents to be used in the present invention include N-methyl-p-aminophenol, p-aminophenyl, N-(β-hydroxyethyl)-p-aminophenol, N-(4-hydroxyphenyl)glycine, 2-methyl-p-aminophenol, p-benzylaminophenol, etc., and among them, N-methyl-p-aminophenol is especially preferred.

In the present invention, said dihydroxybenzene type developing agent is used as a main developing agent and the other said p-aminophenol type developing agent as an auxiliary developing agent; and the amount of the former dihydroxybenzene type developing agent to be used is preferably within the range of 0.05 to 0.5 mol/l and that of the latter p-aminophenol developing agent to be used is preferably within the range not exceeding 0.06 mol/l.

The sulfites to be used as a preservative in the present invention include sodium sulfite, potassium sulfite, lithium sulfite, sodium bisulfite, potassium metabisulfite, formaldehyde sodium bisulfite, etc. The amount of said sulfite to be used is at least 0.3 mol/l. Addition of too much of said sulfite to a developer causes a precipitate in the developer, resulting in staining of the developer solution, and therefore, the upper limit of said amount is preferably 1.2 mol/l.

Alkanolamines to be used in the present invention are represented by the general formula (II):

$$(C_2H_5)_2N—R_2 \quad (II)$$

In said formula, $R_2$ represents a hydroxyalkyl group having 2 to 10 carbon atoms, and this may contain two or more hydroxy groups. Examples of said amines are 3-diethylamino-1,2-propanediol, 3-diethylaminopropanol, 2-diethylaminoethanol, etc. The amount of said alkanolamine to be used is in general within the range of 0.05 to 0.3 mol/l.

Mercapto compounds to be used in the present invention are represented by the general formula (III):

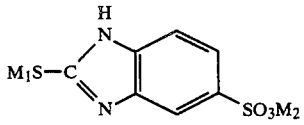

(III)

In this formula, $M_1$ and $M_2$ are the same or different and each is a hydrogen atom, an alkali metal atom or an ammonium group.

Examples of said mercapto compounds (5) to be used in the present invention are sodium 2-mercaptobenzimidazole-5-sulfonate, 2-mercaptobenzimidazole-5-sulfonic acid, etc. The amount of said mercapto compound to be used is in general within the range of $10^{-4}$ to $10^{-2}$ mol/l.

The pH value of the developer of the present invention is to be kept within the range of 10.5 to 12.3. An alkaline agent to be used in the present developer for the regulation of said pH value range may be a conventional water-soluble inorganic alkali metal salt (for example, sodium hydroxide, sodium carbonate, potassium tertiary phosphate, etc.). In addition, the above mentioned alkanolamines may be used for the purpose of attaining the desired pH value.

The developer of the present invention may additionally contain a pH buffer agent such as boric acid, borax, trisodium phosphate, tripotassium phosphate, etc.; a restrainer such as potassium bromide, potassium iodide, etc.; an organic solvent such as ethylene glycol, diethylene glycol, triethylene glycol, dimethylformamide, methyl cellosolve, hexylene glycol, ethanol, methanol, etc.; an antifogging agent or a black pepper inhibitor such as an imidazole compound (e.g., 5-nitroimidazole), a benzotriazole compound (e.g., 5-methylbenzotriazole), etc.; and in addition, the present developer may further contain, if necessary, a color toner, a surfactant, a water softener, a hardening agent, etc.

As a fixing solution, any conventional ones may be used. As a fixing agent may be used a thiosulfate and a thiocyanate, and in addition, any other organic sulfur compounds which are known to be effective as a fixing agent may also be used. As an oxidizing agent ethylenediaminetetraacetate-iron (III) complex may be used.

The temperature upon development treatment is selected in general from the range of 18° to 50° C., but said temperature may optionally be lower than 18° C. or may optionally be higher than 50° C.

The method of the present invention is especially suitable for a rapid access using an automatic development machine. The automatic development machine may be any type of a roller conveyance system, a belt conveyance system or other system. The access time may be short, totaling 2 minutes or less, especially 100 seconds or less, and among them, the time alloted for the development may be 15 to 60 seconds. The developer of the present invention may sufficiently attain the effect even in such rapid development.

Next, hydrazine derivatives to be used in the present invention will be explained in detail.

The hydrazine derivatives of the present invention are those represented by the general formula (I):

$$R_1\text{—NHNH—CHO} \quad \text{(I)}$$

where $R_1$ is a substituted or unsubstituted aryl group.

Typical substituents include a linear, branched or cyclic alkyl group (preferably having 1 to 20 carbon atoms), an aralkyl group (preferably mono- or dicyclic group where the alkyl moiety contains 1 to 3 carbon atoms), an alkoxy group (preferably having 1 to 20 carbon atoms), a substituted amino group (preferably substituted by (an) alkyl group(s) having 1 to 20 carbon atoms), an acylamino group (preferably having 2 to 30 carbon atoms), a sulfonamide group (preferably having 1 to 30 carbon atoms), a ureido group (preferably having 1 to 30 carbon atoms), etc. $R_1$ in said general formula (I) may contain a ballast group which is generally used in an immobilized photographic additive such as a coupler. Said ballast groups are those having 8 or more carbon atoms, which are relatively inactive to photographic characteristics, and, for example, may be selected from an alkyl group, an alkoxy group, a phenyl group, an alkylphenyl group, a phenoxy group, an alkylphenoxy group, etc. $R_1$ in said general formula (I) may further contain an adsorbent group capable of reinforcing the adsorbability of said hydrazine derivative to the surface of silver halide particles. Examples of said adsorbent groups include thiourea groups, heterocyclic thioamido groups, mercaptoheterocyclic groups, triazole groups, etc., as described in U.S. Pat. No. 4,385,108.

Synthesis of said compounds is described, for example, in Japanese Patent Application (OPI) Nos. 20921/78, 20922/78, 66732/78, 20318/78, etc.

In the present invention, when the compound of the general formula (I) is to be incorporated in a photographic material, said compound is preferably incorporated in a silver halide emulsion layer of said material, which is not limiting, however. Said hydrazine derivative may freely be incorporated in any other nonsensitive hydrophilic colloid layers (for example, protective layer, intermediate layer, filter layer, antihalation layer, etc.). In practice, when the compound to be added is soluble in water, this may be added to the hydrophilic colloidal solution in the form of an aqueous solution; or on the contrary, when the compound to be added is hardly soluble in water, said compound may be added thereto in the form of a solution dissolved in an organic solvent which is compatible with water, such as an alcohol, an ester, a ketone, etc. In the case the hydrazine derivative compound is to be added to a silver halide emulsion layer, the addition may be carried out in any desired stage from the beginning of chemical ripening to before coating, and it is preferred to add said compound during the period from after the finish of the chemical ripening to before the coating. In particular, it is most preferred to add said compound to a coating solution just ready for coating.

The amount of the hydrazine derivative compound of the formula (I) to be contained in the photographic material of the present invention is preferably determined to be an optimum content, depending upon the particle size of the silver halide emulsion in said photographic material, the halogen composition in said emulsion, the method and degree of chemical sensitization for said emulsion and the relation between the layer containing said hydrazine derivative compound and the silver halide emulsion layer, as well as upon the kind of antifogging compound used; and the test method for said selection is well known by those skilled in the art. In general, the amount of said compound of the formula (I) is preferably within the range of $10^{-6}$ mol to $1\times10^{-1}$ mol, especially $10^{-5}$ mol to $4\times10^{-2}$ mol, per 1 mol of a silver halide.

Examples of compounds of the formula (I) are given below, which, however, do not whatsoever restrict the scope of the formula (I).

(1)

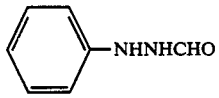

(2)

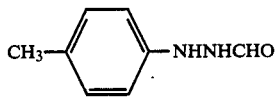

(3)

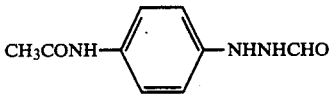

(4)

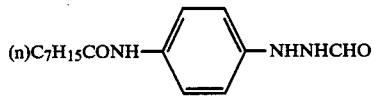

(5)

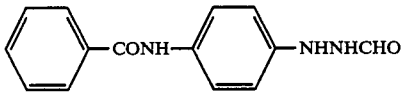

(6)

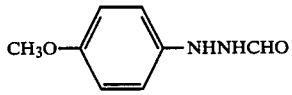

-continued
(7)
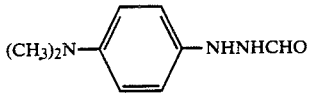
(8)
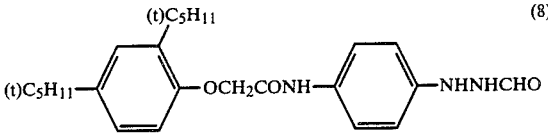
(9)
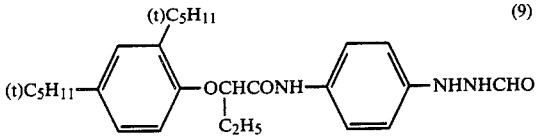
(10)
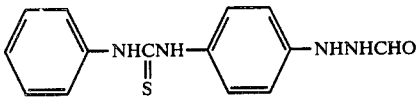
(11)
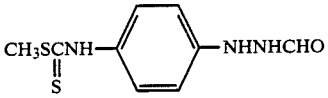
(12)
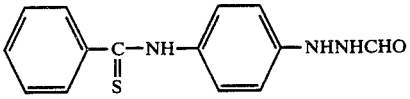
(13)
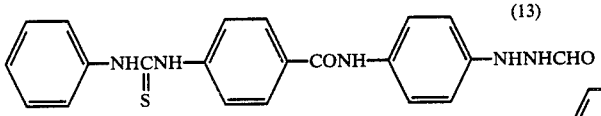
(14)
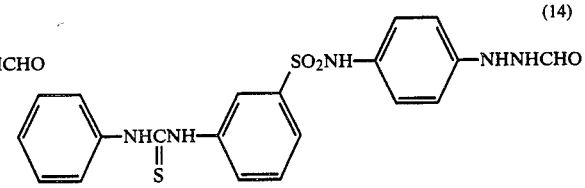
(15)
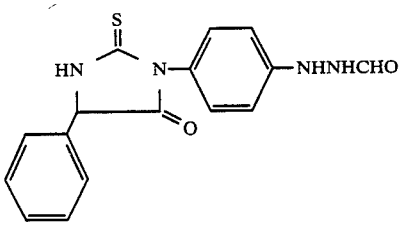
(16)
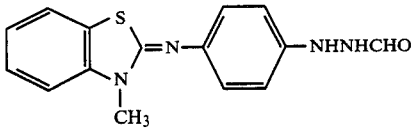
(17)
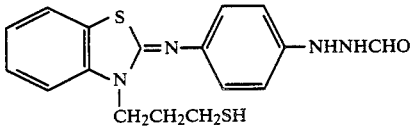
(18)
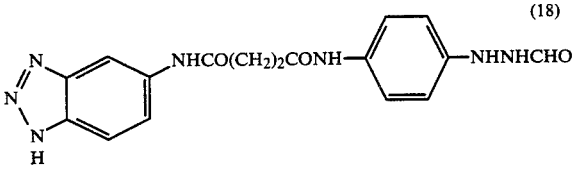
(19)
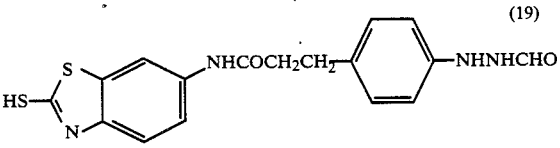
(20)
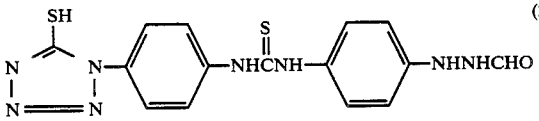
(21)
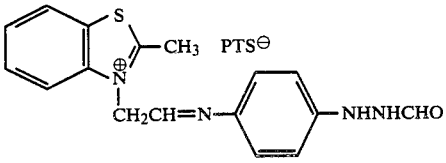
(22)
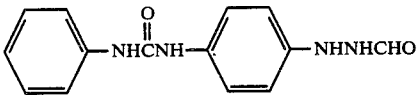
(23)
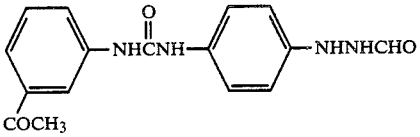
(24)
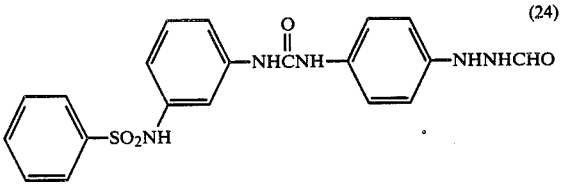

-continued (25)

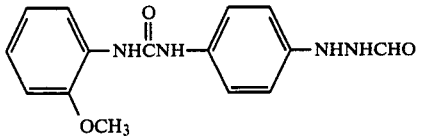

(26)

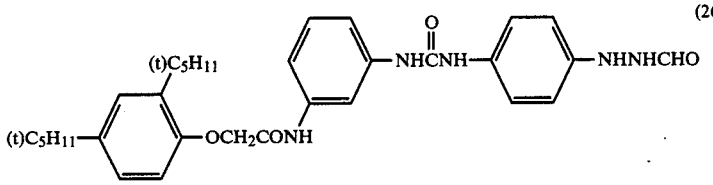

(27)

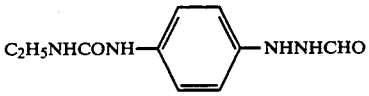

(28)

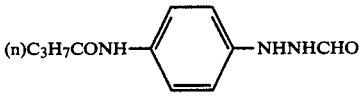

(29)

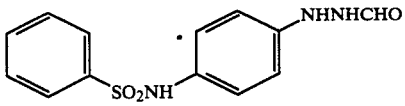

(30)

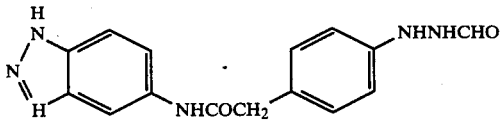

Silver halide photographic materials, to which the method for image formation according to the present invention is to be applied, will be explained in greater detail in the following description.

The halogen composition in the silver halide emulsion used in the present invention is not specifically limited and may be any composition selected from silver chloride, silver chlorobromide, silver iodobromide, silver bromide, silver iodobromochloride, etc. It is preferred that the content of silver iodide is 5 mol % or less, especially 3 mol % or less.

The particle size distribution of the silver halide particles in the photographic emulsion to be used in the present invention may be relatively broad, but said particle size distribution is preferably small, and in particular, it is especially preferred that 90% of the total silver halide particles, said percentage being relative to the weight or to the number of said particles, may have a particle size falling within the range of an average particle size ±40%. (In general, this kind of emulsion is called a monodispersed emulsion.)

The silver halide particles to be used in the present invention are preferably fine particles (for example, 0.7 μm or less), and the particle size thereof is especially preferred to be 0.4 μm or less.

The silver halide particles to be contained in the photographic emulsion may have a regular crystalline form such as a cubic form or an octahedral form, or alternatively may have an irregular crystalline form such as a spherical form or a tabular form, or otherwise may have a composite crystal form comprising a mixture of said regular and irregular crystalline forms.

The silver halide particles may comprise uniform inner phase and outer surface layer phase or may comprise different phases therebetween.

A mixture of two or more different silver halide emulsions, which have been prepared differently and individually, may be used in the present invention.

In the silver halide emulsion to be used in the present invention, a cadmium salt, a sulfite, a lead salt, a thallium salt, an iridium salt or a complex salt thereof, a rhodium salt or a complex salt thereof, etc., may coexist, during the formation of silver halide particles or during the step of physical ripening thereof.

As the silver halide emulsion, a so-called primitive emulsion, which is not chemically sensitized, can be used. However, a chemically sensitized one may also be used. Various methods can be used for the chemical sensitization as described in *Chimie et Photographique,* written by P. Glafkides and published by Paul Montel (1957); *Photographic Emulsion Chemistry,* written by G. F. Duffin and published by The Focal Press (1966); *Making and Coating Photographic Emulsion,* written by V. L. Zelikman, et al. and published by The Focal Press (1964); and *Die Grundlagen der Photographischen Prozesse mit Silberhalogeniden,* edited by H. Frieser and published by Akademische Verlagsgesellschaft (1968).

As described in said literature, chemical sensitization may be carried out, for example, by a sulfur sensitization method where a sulfur-containing compound capable of reacting with an active gelatin and silver (such as thiosulfate, thioureas, mercapto compounds, rhodamines, etc.) is used; a reductive sensitization method where a reducing substance (such as stannous salts, amines, hydrazine derivatives, formamidine-sulfinic acids, silane compounds, etc.) is used; or a noble metal sensitization method where a noble metal compound (such as gold compounds as well as complex salts of group VIII metals (of Periodic Table) including platinum, iridium, palladium, etc.) is used. Said sensitization method may be carried out singly or in the form of a combination of two or more means.

Gelatin is preferred as a binder or a protective colloid which may be used in an emulsion layer or in an intermediate layer of the photographic materials of the present invention, and other hydrophilic colloids may also be used therefor.

For example, the following substances may be used: gelatin derivatives, graft polymers of gelatin with other high molecular compounds, proteins such as albumin, casein, etc.; cellulose derivatives such as hydroxyethyl cellulose, carboxymethyl cellulose, cellulose sulfates, etc.; saccharide derivatives such as sodium alginate, starch derivatives, etc.; and other various kinds of synthetic hydrophilic high molecular substances of mono- or copolymers such as polyvinyl alcohol, partially acetallized polyvinyl alcohol, poly-N-vinylpyrrolidone, polyacrylic acid, polymethacrylic acid, polyacrylamide, polyvinylimidazole, polyvinylpyrazole, etc.

As said gelatin substance may be used a lime-treated gelatin and an acid-treated gelatin, as well as an enzyme-treated gelatin as described in *Bull. Soc. Sci. Phot. Japan,* No. 16, page 30 (1966). In addition, hydrolyzed products or enzyme-decomposed products of gelatin may also be used.

The photographic emulsion to be used in the present invention may be spectrally sensitized by the use of methine dyes or the like. Dyes which may be used for said purpose of spectral sensitization include cyanine dyes, merocyanine dyes, complex cyanine dyes, complex merocyanine dyes, holopolar cyanine dyes, hemicyanine dyes, styryl dyes and hemioxonol dyes. Especially valuable dyes are those belonging to cyanine dyes, merocyanine dyes and complex merocyanine dyes. Any and every basic heterocyclic nucleus which may generally be contained in cyanine dyes may be applied to said dyes. For instance, such nuclei include pyrroline, oxazoline, thiazoline, pyrrole, oxazole, thiazole, selenazole, imidazole, tetrazole and pyridine nuclei, etc.; aliphatic hydrocarbon ring-fused heterocyclic nuclei; and aromatic hydrocarbon ring-fused heterocyclic nuclei such as indolenine, benzindolenine, indole, benzoxazole, naphthoxazole, benzothiazole, naphthothiazole, benzoselenazole, benzimidazole and quinoline nuclei, etc. These nuclei may be substituted on carbon atoms. Merocyanine dyes and complex merocyanine dyes may contain ketomethylene structure-containing 5- or 6-membered heterocyclic nuclei such as pyrazolin-5-one, thiohydantoin, 2-thiooxazolidine-2,4-dione, thiazolidine-2,4-dione, rhodamine and thiobarbituric acid nuclei, etc.

Other dyes which per se do not have any spectral sensitization activity or some other substances which do not substantially absorb any visible ray but have a supersensitization activity may be incorporated in the emulsion, together with said sensitizing dyes. For instance, nitrogen-containing heterocyclic ring-substituted aminostilbene compounds (for example, those as described in U.S. Pat. Nos. 2,933,390 and 3,635,721), aromatic organic acid/formaldehyde condensation products (for example, those as described in U.S. Pat. No. 3,743,510), cadmium salts, azaindene compounds, etc., may be incorporated in the emulsion. In particular, the combinations as described in U.S. Pat. Nos. 3,615,613, 3,615,641, 3,617,295 and 3,635,721 are preferred for the supersensitization.

Other various compounds may further be incorporated in the photographic emulsion to be used in the present invention, in order to prevent the occurrence of fog or to stabilize the photographic characteristics during the manufacture or preservation of photographic materials or during the photographic treatment thereof. For instance, various compounds which are known as an antifogging agent or a stabilizer may be added to the present photographic emulsion, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), etc.; mercaptopyrimidines; mercaptotriazines; thioketo compounds such as oxazolinethione; azaindenes such as triazaindenes, tetraazaindenes (especially, 4-hydroxy-substituted-(1,3,3a,7)tetraazaindenes), pentaazaindenes, etc.; benzenethiosulfonic acid, benzenesulfinic acid, benzenesulfonic acid amide, etc.

Among them, benzotriazoles (e.g., 5-methylbenzotriazole) and nitroindazoles (e.g., 5-nitroindazole) are especially preferred. These compounds may be added to a treating solution.

The photographic materials of the present invention may contain an inorganic or organic hardening agent in the photographic emulsion layer or in the other hydrophilic colloid layer. For example, chromium salts (such as chromium alum, chromium acetate, etc.), aldehydes (such as formaldehyde, glyoxal, glutaraldehyde, etc.), N-methylol compounds (such as dimethylolurea, methyloldimethylhydantoin, etc.), dioxane derivatives (such as 2,3-dihydroxydioxane, etc.), active vinyl compounds (such as 1,3,5-triacryloyl-hexahydro-s-triazine, 1,3-vinylsulfonyl-2-propanol, etc.), active halogen compounds (such as 2,4-dichloro-6-hydroxy-s-triazine, etc.) and mucohalogenic acids (such as mucochloric acid, mucophenoxychloric acid, etc.) may be used singly or in the form of a combined mixture of said compounds.

The photographic materials of the present invention may further contain various kinds of surfactants, in the photographic emulsion layer or in the other hydrophilic colloid layer, for various purposes of coating assistance, static charge prevention, slide property improvement, dispersive emulsification, antiadhesion and photographic characteristic improvement (for example, development acceleration, high contrast achievement, sensitization).

For instance, said surfactants include nonionic surfactants such as saponins (steroid type), alkylene oxide derivatives (e.g., polyethylene glycol, polyethylene glycol/polypropylene glycol condensation products, polyethylene glycol alkylethers or polyethylene glycol alkylarylethers, polyethylene glycol esters, polyethylene glycol sorbitan esters, polyalkylene glycol alkylamines or alkylamides, silicone-polyethylene oxide adducts, etc.), glycidol derivatives (e.g., alkenylsuccinic acid polyglycerides, alkylphenol polyglycerides, etc.), fatty acid esters of polyhydric alcohols and alkylesters of saccharides; anionic surfactants containing an acidic group such as a carboxyl, sulfo, phospho, sulfuric ester or phosphoric ester group, for example, alkylcarboxylic acid salts, alkylsulfonic acid salts, alkylbenzenesulfonic acid salts, alkylnaphthalenesulfonic acid salts, alkyl sulfates, alkyl phosphates, N-acyl-N-alkyltaurines, sulfosuccinic acid esters, sulfoalkylpolyoxyethylene alkylphenylethers, polyoxyethylene alkyl phosphates, etc.; ampholytic surfactants such as amino acids, aminoalkylsulfonic acids, aminoalkyl sulfates or phosphates, alkylbetaines, amine oxides, etc.; and cationic surfactants such as alkylamine salts, aliphatic or aromatic quaternary ammonium salts, heterocyclic quaternary ammonium salts (e.g., pyridinium or imidazolium salts), aliphatic or heterocyclic ring-containing phosphonium or sulfonium salts, etc.

Especially preferred surfactants in the present invention are polyalkylene oxides having a molecular weight of 600 or more, which are described in Japanese Patent Publication No. 9412/83.

The photographic materials of the present invention may further contain a dispersion of a water-insoluble or hardly soluble synthetic polymer in the photographic emulsion layer or in the other hydrophilic colloid layer, for the purpose of improvement of the dimensional stability of the photographic materials. For example, polymers or copolymers of alkyl (meth)acrylates, alkoxyalkyl (meth)acrylates, glycidyl (meth)acrylates, (meth)acrylamides, vinyl esters (e.g., vinyl acetate), acrylonitriles, olefins, styrenes, etc.; as well as those formed by the combination of said monomers and acrylic acids, methacrylic acids, $\alpha,\beta$-unsaturated dicarboxylic acids, hydroxyalkyl (meth)acrylates, sulfoalkyl (meth)acrylates, styrenesulfonic acids, etc., may be used therefor.

The present invention will now be explained in greater detail by reference to the following Examples which are not meant to be limiting.

EXAMPLE 1

To a silver iodobromide emulsion containing 2.5 mol % of iodide and having a particle shape of 0.3 μm cubic form were added 230 mg/1 mol (silver) of anhydro-5,5-dichloro-9-ethyl-3,3'-bis(3-sulfopropyl)oxacarbocyanine hydroxide sodium salt (sensitizing dye), 1.3 g/1 mol (silver) of the above mentioned Compound No. 9 (hydrazine derivative) and 300 mg/1 mol (silver) of polyethylene glycol (molecular weight: about 1,000); and then a dispersion comprising 5-methylbenzotriazole, 4-hydroxy-6-methyl-1,3,3a,7-tetraazaindene and polyethyl acrylate, and 2-hydroxy-1,3,5-triazine sodium salt were further added thereto.

The thus prepared coating solution was coated on a polyethylene terephthalate film support to obtain Film A, where the coated silver amount was 4.0 g/m$^2$ and the coated gelatin amount was 2.5 g/m$^2$.

In comparison, another Film B was formed in the same manner as Film A, with the exception that Compound No. 9 was not added.

These films were sensitometrically exposed using an exposure wedge and a 150 line magenta contact screen, and then the films were developed using various kinds of developers each comprising a different composition as shown below, at 38° C. for 30 seconds, and thereafter fixed, rinsed and dried. (This treatment was carried out by the use of an automatic development machine FG 660F made by Fuji Photo Film Co., Ltd.).

The following Table 1 shows photographic characteristics attained by the use of a fresh developer (immediately after prepared) and those by the use of a fatigued developer. In the latter case, 120 cc of a developer was replenished with every development of a wholly exposed film having a half area of a size (50.8 cm×61.0 cm), and thus, 200 sheets of the exposed films were developed every day continuously for 5 days by a running treatment system. The resulting photographic characteristics and the degree of silver stain are given in Table 1.

Developer A:

| | |
|---|---|
| Tetrasodium ethylenediaminetetraacetate | 1.0 g |
| Sodium hydroxide | 13.0 g |
| Tripotassium phosphate | 74.0 g |
| Potassium sulfite | 90.0 g |
| 3-Diethylamino-1,2-propanediol | 15.0 g |
| N—Methyl-p-aminophenol.½sulfate | 0.8 g |
| Hydroquinone | 35.0 g |
| 5-Methylbenzotriazole | 0.5 g |
| Sodium bromide | 3.0 g |
| Water to make | 1 liter (pH 11.6) |

Developer B:

230 mg ($10^{-3}$ mol) of 2-mercaptobenzimidazole-5-sulfonic acid was added to 1 liter of the above Developer A.

Developer C:

252 mg ($10^{-3}$ mol) of sodium 2-mercaptobenzimidazole-5-sulfonate was added to 1 liter of the above Developer A.

Developer D:

310 mg ($10^{-3}$ mol) of 2-mercaptobenzimidazole-5,7-disulfonic acid was added to 1 liter of the above Developer A.

Developer E:

244 mg ($10^{-3}$ mol) of 2-mercapto-6-methylbenzimidazole-5-sulfonic acid was added to 1 liter of the above Developer A.

Developer F:

244 mg ($10^{-3}$ mol) of 2-mercapto-7-methylbenzimidazole-5-sulfonic acid was added to 1 liter of the above Developer A.

Developer G:

247 mg ($10^{-3}$ mol) of 2-mercaptobenzothiazole-5-sulfonic acid was added to 1 liter of the above Developer A.

TABLE 1

| | | | Properties of Fresh Developer | | | Properties of Fatigued Developer | | | |
|---|---|---|---|---|---|---|---|---|---|
| Test No. | Film | Developer | Sensitivity | Gradient | Halftone Image Quality | Sensitivity | Gradient | Halftone Image Quality | Silver Stain |
| 1 | A | A | 100 | 18 | 5 | 100 | 18 | 5 | 2 |
| 2 | " | B | 100 | 18 | 5 | 100 | 18 | 5 | 5 |
| 3 | " | C | 100 | 18 | 5 | 100 | 18 | 5 | 5 |
| 4 | " | D | 80 | 9 | 3 | 80 | 9 | 3 | 5 |
| 5 | " | E | 80 | 8 | 3 | 80 | 8 | 3 | 5 |
| 6 | " | F | 80 | 9 | 3 | 80 | 9 | 3 | 5 |
| 7 | " | G | 80 | 7 | 3 | 80 | 7 | 3 | 5 |
| 8 | B | A | 25 | 4 | 2 | — | — | — | — |
| 9 | " | B | 25 | 4 | 2 | — | — | — | — |
| 10 | " | C | 25 | 4 | 2 | — | — | — | — |
| 11 | " | D | 25 | 4 | 2 | — | — | — | — |
| 12 | " | E | 25 | 4 | 2 | — | — | — | — |
| 13 | " | F | 25 | 4 | 2 | — | — | — | — |
| 14 | " | G | 25 | 4 | 2 | — | — | — | — |

In the above Table 1, the sensitivity in each test case is a relative one, where a reciprocal of an exposure amount required for obtaining a density of 1.5 when Film A was treated with Developer A is set as an index of 100.

The gradient is a datum of tan $\theta$ of the density (0.3) and the logarithmic exposure amount (3.0) on the gradation characteristic curve.

The halftone image quality is shown using visual grades of 1 through 5, in which "5" is the best, and "1" is the worst. The grades "5" and "4" mean practicable qualities as an original halftone film for plate making; the grade "3" means a coarse quality and is barely practicable; and the grades "2" and "1" mean impracticable ones.

The silver stain is shown also using numerical grades 1 through 5, in which "5" means occurrence of no silver stain on the surface of a film having an area of 9.0 cm×25.0 cm; and "1" means occurrence of extreme silver stain over the whole surface of said film. The grade "4" means a slight occurrence of silver stain partly on the surface of a film, and this is allowable in a practical use. The grade "3" and the lower mean impracticable ones.

As is apparent from the results shown in the above described Table 1, each of Developers A, D, E, F and G using other silver stain preventing agents than the above described component (5) of the present invention injured or deteriorated the sensitizing effect and the high contrast yielding effect of the hydrazine derivative contained in the photographic material, and as a result, no desired photographic characteristics could be attained.

In contrast, when Film A was treated with Developers B and C each comprising the composition of the present invention, no silver stain occurred, and in addition, high sensitivity and high gradation could be attained in both cases using a fresh developer and a fatigued developer (in 5-day-running treatment). Thus, Developers B and C of the present invention were proved to be effective and superior to any other conventional developers.

EXAMPLE 2

The same Film A as used in the above Example 1 was treated using each of Developers H and J as shown below, in the same manner as in said Example 1.

| | |
|---|---|
| Tetrasodium ethylenediaminetetraacetate | 1.0 g |
| Sodium hydroxide | 13.0 g |
| Tripotassium phosphate | 74.0 g |
| Potassium sulfite | 90.0 g |
| N—Methyl-p-aminophenol.½sulfate | 0.8 g |
| Hydroquinone | 35.0 g |
| 5-Methylbenzotriazole | 0.5 g |
| Sodium bromide | 3.0 g |
| 2-Mercaptobenzimidazole-5-sulfonic acid | 0.252 g |
| 3-Diethylamino-1,2-propanediol | 15.0 g |
| Water to make | 1 liter (pH 11.6) |

Developer H:

Developer J:

0.8 g of N-methyl-p-aminophenol.½sulfate in the above mentioned Developer H was replaced by an equivalent molar amount of 4-methyl-4-hydroxymethyl-1-phenyl-3-pyrazolidone.

The obtained test results are given in the following Table 2, where each test condition is as follows:

Test Condition "1":

A fresh developer was used.

Test Condition "2":

A developer was put in a beaker having a capacity of 1 liter, which was then left open for 7 days, whereby the developer was placed in a severe condition to be exposed to air oxidation and the pH value thereof increased thereby. The thus deteriorated developer was used.

Test Condition "3":

10 sheets of Film A, each having a complete large size (50.8 cm×61.0 cm) and having been wholly exposed, were treated in 1 liter of a developer, whereby the pH value of the developer decreased due to the development reaction of said films. The developer thus fatigued under such severe conditions was used.

TABLE 2

| Test No. | Test Condition (Developer) | Sensitivity | Gradient | Halftone Image Quality |
|---|---|---|---|---|
| 15 | 1 (H) | 100 | 18 | 5 |
| 16 | 2 (H) | 113 | 18 | 5 |
| 17 | 3 (H) | 95 | 15 | 5 |
| 18 | 1 (J) | 100 | 18 | 5 |
| 19 | 2 (J) | 120 | 18 | 5 |
| 20 | 3 (J) | 90 | 14 | 5 |

In the above Table 2, the meanings of each term on the photographic characteristics are the same as those defined in Example 1.

As is apparent from the results given in said Table 2, Developer H of the present invention is superior to the other Developer J containing a 3-pyrazolidone type developing agent instead of the above mentioned component (2) of the present invention, in that the former has far smaller variations in the resulting photographic characteristics with varying pH value of the developer than the latter.

While the invention has been described in detail and with reference to specific embodiments thereof, it will be apparent to one skilled in the art that various changes and modifications can be made therein without departing from the spirit and scope thereof.

What is claimed is:

1. A method for high contrast development of an imagewise exposed silver halide photographic material containing a hydrazine derivative of the general formula (I):

$$R_1\text{—NHNHCHO} \quad \text{(I)}$$

wherein $R_1$ is a substituted or unsubstituted aryl group, to form a negative image of high contrast on said photographic material; characterized in that said photographic material is treated with an aqueous alkaline developer having a pH value of 10.5 to 12.3 and comprising the following components (1) through (5):

(1) a dihydroxybenzene developing agent;

(2) a p-aminophenol developing agent;

(3) at least 0.3 mol/l of a sulfite preservative;

(4) 0.05 to 0.30 mol/l of an alkanolamine of the general formula (II):

$$(C_2H_5)_2N\text{—}R_2 \quad \text{(II)}$$

where $R_2$ is a hydroxyalkyl group having 2 to 10 carbon atoms; and (5) $10^{-4}$ to $10^{-2}$ mol/l of a mercapto compound of the general formula (III):

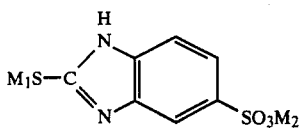

(III)

where $M_1$ and $M_2$ are the same or different and each is a hydrogen atom, an alkali metal atom or an ammonium group.

2. The method for high contrast development of a silver halide photographic material as claimed in claim 1, wherein said dihydroxybenzene developing agent (1) is one member selected from the group consisting of hydroquinone, chlorohydroquinone, bromohydroquinone, isopropylhydroquinone, methylhydroquinone, 2,3-dichlorohydroquinone, 2,3-dibromohydroquinone and 2,5-dimethylhydroquinone.

3. The method for high contrast development of a silver halide photographic material as claimed in claim 2, wherein said dihydroxybenzene developing agent (1) is hydroquinone.

4. The method for high contrast development of a silver halide photographic material as claimed in claim 1, wherein said p-aminophenol developing agent (2) is one member selected from the group consisting of N-methyl-p-aminophenol, p-aminophenol, N-(β-hydroxyethyl)-p-aminophenol, N-(4-hydroxyphenyl)glycine, 2-methyl-p-aminophenol and p-benzylaminophenol.

5. The method for high contrast development of a silver halide photographic material as claimed in claim 4, wherein said p-aminophenol developing agent (2) is N-methyl-p-aminophenol.

6. The method for high contrast development of a silver halide photographic material as claimed in claim 1, wherein the amount of said dihydroxybenzene developing agent (1) is within the range of 0.05 to 0.5 mol/l, and the amount of said p-aminophenol type developing agent (2) is 0.06 mol/l or less.

7. The method for high contrast development of a silver halide photographic material as claimed in claim 1, wherein said sulfite preservative (3) is one member selected from the group consisting of sodium sulfite, potassium sulfite, lithium sulfite, sodium bisulfite, potassium metabisulfite and formaldehyde sodium bisulfite.

8. The method for high contrast development of a silver halide photographic material as claimed in claim 1, wherein said alkanolamine (4) is one member selected from the group consisting of 3-diethylamino-1,2-propanediol, 3-diethylaminopropanol and 2-diethylaminoethanol.

9. The method for high contrast development of a silver halide photographic material as claimed in claim 1, wherein said mercapto compound (5) is selected from sodium 2-mercaptobenzimidazole-5-sulfonate and 2-mercaptobenzimidazole-5-sulfonic acid.

* * * * *